United States Patent [19]

Penninger

[11] Patent Number: 4,647,429

[45] Date of Patent: Mar. 3, 1987

[54] CORROSION INHIBITORS FOR ALUMINUM

[75] Inventor: Josef Penninger, Hilden, Fed. Rep. of Germany

[73] Assignee: Henkel Kommanditgesellschaft auf Aktien, Duesseldorf, Fed. Rep. of Germany

[21] Appl. No.: 757,839

[22] PCT Filed: Nov. 2, 1984

[86] PCT No.: PCT/EP84/00347

§ 371 Date: Jul. 11, 1985

§ 102(e) Date: Jul. 11, 1985

[87] PCT Pub. No.: WO85/02206

PCT Pub. Date: May 23, 1985

[30] Foreign Application Priority Data

Nov. 14, 1983 [DE] Fed. Rep. of Germany ..... 3341152

[51] Int. Cl.[4] ..... C23F 11/04; C23F 11/167

[52] U.S. Cl. ..... 422/12; 422/15; 252/389.22; 252/390

[58] Field of Search ..... 252/389.22, 390; 422/12, 15

[56] References Cited

U.S. PATENT DOCUMENTS

| | | | |
|---|---|---|---|
| 3,553,101 | 1/1971 | Foroulis | 208/47 |
| 3,935,125 | 1/1976 | Jacob | 252/389.22 X |
| 4,298,568 | 11/1981 | Gerhardt et al. | 422/15 X |
| 4,303,546 | 12/1981 | Waegerle | 422/15 X |
| 4,317,744 | 3/1982 | Levi | 422/15 X |
| 4,409,121 | 10/1983 | Latos et al. | 422/15 X |
| 4,452,758 | 6/1984 | Wilson et al. | 422/15 |

FOREIGN PATENT DOCUMENTS

| | | | |
|---|---|---|---|
| 2014864 | 4/1970 | France . | |
| 1222133 | 2/1971 | United Kingdom | 252/390 |
| 2094776 | 9/1982 | United Kingdom . | |

OTHER PUBLICATIONS

"Dequest 2000—Technical Report" published by Monsanto GmbH, Germany, (1979), pp. 1–7.

*Primary Examiner*—John F. Terapane
*Assistant Examiner*—Matthew A. Thexton
*Attorney, Agent, or Firm*—Ernest G. Szoke; Henry E. Millson, Jr.; Mark A. Greenfield

[57] ABSTRACT

A corrosion inhibitor for aluminum in aqueous acidic compositions comprising 3-amino-5-alkyl-1,2,4-triazoles and aminotris(methylenephosphonic acid); and a method for its use.

19 Claims, No Drawings

CORROSION INHIBITORS FOR ALUMINUM

BACKGROUND OF THE INVENTION

1. Field of the Invention

This invention relates to corrosion inhibitors for aluminum in aqueous acidic systems based on 3-amino-5-alkyl-1,2,4-triazoles in combination with the aminotris(-methylenephosphonic acid).

2. Statement of Related Art

It is known that the corrosion of aluminum in aqueous systems may be reduced by suitable additives such as alkali silicates or sodium benzoate. Such compounds show good efficacy in the neutral range, and especially in the case of alkali silicates, in the basic range. On the other hand alkali silicates are not usable in the acid range, while the desired protection in the said range can be achieved with sodium benzoate only at high concentrations.

DESCRIPTION OF THE INVENTION

It has now been found that over a broad acid range (pH 1–6) a mixture of (a) 3-amino-5-alkyl-1,2,4-triazoles and (b) aminotris(methylenephosphonic acid)

can be used with excellent results as corrosion inhibitors for aluminum in aqueous systems.

Triazoles in which the alkyl moiety contains 2 to 10, preferably 7 to 9, carbon atoms are especially suitable.

It has also been found that it is advantageous if the triazoles used are present, relative to the aminotris(methylenephosphonic acid), at a weight ratio of 1–10:1, preferably 5:1.

A synergistic effect then surprisingly arises, in the considerably better results are achieved with the inventive combination than with the individual components. In addition, aminotris(methylenephosphonic acid) has proven especially suitable, while such effects are not obtained with comparable commercial phosphonic acid, such as 1-hydrxyethane-1,1-diphosphonic acid or 2-phosphonobutane-1,2,4,-tricarboxylic acid.

The described mixtures of 3-amino-5-alkyl-1,2,4-triazoles and aminotris(methylenephosphonic acid) are used in quantities of 50 to 1000 g/m$^3$, preferably 200 to 500 g/m$^3$.

The production of the aminoalkyl-1,2,4-triazoles used is accomplished according to methods known in and of themselves, for example by reacting fatty acid with aminoguanidine hydrogen carbonate. However, the preparation of these compounds is not the subject of this invention.

EXAMPLES

The determination of the anticorrosion properties is accomplished in the manner described in the following.

Each of three carefully pretreated and weighed test strips (80×15×1 mm) is suspended in a 1 liter test vessel containing 800 ml test water and a defined amount of substance to be investigated and left therein for 18 hr at room temperature and 80 rpm.

The corrosion protection value S, relative to a blank sample, was calculated from the weight loss.

$$S = 100\left(1\frac{a}{b}\right)$$

a=sample weight loss b=blank weight loss

The test water used as the corrosive medium was prepared according to German Industrial Norm (DIN) 51,360/2 and adjusted with concentrated sulfuric acid to a pH value of 1.

The respective inhibitors, their concentrations, and the corrosion protection achieved in each case are given in % in the table which follows. Example No. 7 is in accordance with this invention. Examples 1 and 2 demonstrate that the two invention ingredients are considerably less effective taken alone. Examples 3 and 4 are for compounds considered comparable to ATMP, as indicated above. Examples 5 and 6 demonstrate that combining the compounds of examples 3 and 4 with HAT still does not afford satisfactory corrosion protection.

| No. | Inhibitor | Concentration g/m$^3$ | Corrosion protection in % |
|---|---|---|---|
| 1 | HAT | 500 | 74 |
| 2 | ATMP | 500 | 73 |
| 3 | HEDP | 500 | 68 |
| 4 | PBTC | 500 | 66 |
| 5 | HAT/HEDP | 250/50 | 77 |
| 6 | HAT/PBTC | 250/50 | 76 |
| 7 | HAT/ATMP | 250/50 | 92 |

The following abbreviations are used in the table:

HAT=3-heptyl-5-amino-1,2,4-triazole

HEDP=1-hydroxyethane-1,1-diphosphonic acid

ATMP=aminotris(methylenephosphonic acid)

PBTC=2-phosphonobutane-1,2,4-tricarboxylic acid.

I claim:

1. A corrosion inhibitor for aluminum in aqueous acidic systems consisting essentially of:

(a) 3-amino-5-alkyl-1,2,4-triazoles; and (b) aminotris(methylenephosphonic acid);

in a weight ratio a:b of 1–10:1.

2. The inhibitor of claim 1 having a weight ratio a:b of about 5:1.

3. The inhibitor of claim 1 wherein the alkyl moiety in the 3-amino-5-alkyl-1,2,4-triazoles contains 2 to 10 carbon atoms.

4. The inhibitor of claim 2 wherein the alkyl moiety in the 3-amino-5-alkyl-1,2,4-triazoles contains 2 to 10 carbon atoms.

5. The inhibitor of claim 1 wherein the alkyl moiety in the 3-amino-5-alkyl-1,2,4-triazoles contains 7 to 9 carbon atoms.

6. The inhibitor of claim 2 wherein the alkyl moiety in the 3-amino-5-alkyl-1,2,4-triazoles contains 7 to 9 carbon atoms.

7. A method for inhibiting corrosion in an aqueous acidic system comprising adding to said system a corrosion-inhibitive effective amount of a corrosion inhibitor consisting essentially of:

(a) 3-amino-5-alkyl-1,2,4-triazoles; and (b) aminotris(methylenephosphonic acid).

8. The method of claim 7 wherein the corrosion inhibitor ingredients are present in a weight ratio a:b of 1–10:1.

9. The method of claim 7 wherein the corrosion inhibitor ingredients are present in a weight ratio a:b of about 5:1.

10. The method of claim 7 wherein said corrosion inhibitor is added to an aqueous acid system in a quantity of 50 to 1,000 g/m$^3$.

11. The method of claim 8 wherein said corrosion inhibitor is added to an aqueous acid system in a quantity of 50 to 1,000 g/m$^3$.

12. The method of claim 9 wherein said corrosion inhibitor is added to an aqueous acid system in a quantity of 50 to 1,000 g/m$^3$.

13. The method of claim 7 wherein said corrosion inhibitor is added to an aqueous acid system in a quantity of 200 to 500 g/m$^3$.

14. The method of claim 8 wherein said corrosion inhibitor is added to an aqueous acid system in a quantity of 200 to 500 g/m$^3$.

15. The method of claim 9 wherein said corrosive inhibitor is added to an aqueous acid system in a quantity of 200 to 500 g/m$^3$.

16. The method of claim 7 wherein the alkyl moiety in the 3-amino-5-alkyl-1,2,4-triazoles contains 2 to 10 carbon atoms.

17. The method of claim 11 wherein the alkyl moiety in the 3-amino-5-alkyl-1,2,4-triazoles contains 2 to 10 carbon atoms.

18. The method of claim 7 wherein the alkyl moiety in the 3-amino-5-alkyl-1,2,4-triazoles contains 7 to 9 carbon atoms.

19. The method of claim 15 wherein the alkyl moiety in the 3-amino-5-alkyl-1,2,4-triazoles contains 7 to 9 carbon atoms.

* * * * *